US005870920A

United States Patent [19]

Drigani et al.

[11] Patent Number: 5,870,920

[45] Date of Patent: Feb. 16, 1999

[54] DEVICE TO MOVE THE ROLLS IN A FOUR-HIGH ROLLING STAND FOR SHEET AND WIDE PLATE

[75] Inventors: Fausto Drigani, Zugliano-Pozzuolo del Friuli; Estore Donini, Vimercate, both of Italy

[73] Assignee: Danieli & C. Officine Meccaniche SpA, Buttrio, Italy

[21] Appl. No.: 844,682

[22] Filed: Apr. 21, 1997

[30] Foreign Application Priority Data

Apr. 19, 1996 [IT] Italy ..... UD96A0051

[51] Int. Cl.[6] ..... B21B 31/07; B21B 31/08

[52] U.S. Cl. ..... 72/247

[58] Field of Search ..... 72/237, 238, 239, 72/240, 245, 247

[56] References Cited

U.S. PATENT DOCUMENTS

| | | | |
|---|---|---|---|
| 4,770,021 | 9/1988 | Kobayashi et al. | 72/247 |
| 4,785,651 | 11/1988 | Kuhn | 72/247 |
| 5,448,901 | 9/1995 | Yu et al. | 72/247 |
| 5,622,073 | 4/1997 | Hiruta et al. | 72/247 |

FOREIGN PATENT DOCUMENTS

| | | |
|---|---|---|
| 0 655284 | 5/1995 | European Pat. Off. . |
| 3145134 | 5/1983 | Germany . |
| 3525462 | 1/1987 | Germany . |

OTHER PUBLICATIONS

Patent Abstracts of Japan vol. 005, No. 037 (M–058) 10 Mar. 81 & JP–A–55 161512 (Hitachi) 16 Dec. 1980—Abstract.

Patent Abstracts of Japan vol. 006, No. 069 (M–125) 30 Apr. 1982 & JP–A–57 009516 (Hitachi) 19 Jan. 1982—Abstract.

*Primary Examiner*—Joseph J. Hail, III
*Assistant Examiner*—Rodney Butler
*Attorney, Agent, or Firm*—Antonelli, Terry, Stout & Kraus, LLP

[57] ABSTRACT

Device to move the rolls in a four-high rolling stand to roll sheet and wide plate, the device comprising jaws (12, 13) cooperating with the chock (14) of the respective lower (11) and upper **(11*a*) roll, the jaws (12, 13) presenting at least a closed position in which they make the chock (14) solid to the system of axial travelling (23, 24) of the rolls (11, 11*a*) and an open position in which they release the rolls (11, 11*a*), the jaws (12, 13) cooperating with respective mating seatings defined laterally to the relative chock (14), each of the jaws (12, 13) being respectively connected to the system of axial travelling (23, 24) by an articulated parallelogram unit able to move on a plane which is substantially at right angles to the rolling plane, the articulated parallelogram unit comprising paired rods, respectively (17,117;18,118), pinned at the front to the respective jaws (12, 13) and associated at the rear with the axial travelling system (23, 24) by an articulation (19)** with at least two axes of rotation.

7 Claims, 4 Drawing Sheets

DEVICE TO MOVE THE ROLLS IN A FOUR-HIGH ROLLING STAND FOR SHEET AND WIDE PLATE

BACKGROUND OF THE INVENTION

This invention concerns a device to move the rolls in a four-high rolling stand to roll sheet and/or wide plate.

The device is applied advantageously in the siderurgical field in operations to position and move the rolls in rolling mill stands to roll sheet and/or wide plate.

In rolling mill stands for sheet and/or wide plate, the state of the art covers the procedure of shifting the coupled working rolls, or one individual roll, in order to distribute the localised wear uniformly, in particular in correspondence with the edge of the rolled stock, and/or to vary the section geometry of the rolled product when shaped rolls are used.

The rolls are shifted and held in position by means of elements connected to a drawing system, having gripping means of a shape suitable to associate with seatings situated on the chocks of the rolls on which the gripping means act.

The gripping means can be engaged or disengaged from the relative seatings and therefore from the chocks, by means of control systems of various types, allowing the roll to be constrained to and released from the drawer every time it is necessary, as for example when the roll is taken out or inserted in the event of replacement or maintenance.

The state of the art also knows the method by which the thickness of the rolled product is controlled, during rolling, by moving the rolls with respect to the rolling plane in such a way as to vary the distance between the rolls.

This moving is carried out by means of mechanical or hydraulic devices with which the rolling stand is endowed.

The movements may take place even during the operating cycle, for example when the product is about to enter the rolling stand.

Each of the two working rolls or at least one of them can therefore be subjected to perpendicular shifting movements in respect to the rolling plane while the surfaces of the chocks are in close contact with the relative gripping means to execute the desired axial shifts.

These movements which are at right angles to the rolling plane cause a slip between the contact surfaces of the gripping means on the drawing device and the mating seatings on the chocks, which in turn determines friction which increases according to the intensity of the axial thrusts given by the working rolls.

The thrusts are greater when there are defects of parallelism between the working rolls and/or their generators, as they tend to generate a reciprocal tightening movement of the rolls.

The slip itself may be caused, as we have said, by the impact with the rolling rolls of the leading end of the rolled product as it arrives. The less precisely the thickness of the product is controlled during rolling, and the greater the reduction of the thickness programmed by the specific rolling stand, the greater the slip.

Solutions have been devised where, during the working cycle, the working rolls undergo a crossing movement (roll-crossing) or where both the working rolls and the back-up rolls together undergo a crossing movement (pair-cross) This gives greater flexibility in controlling the profile of the rolled product.

The crossing of the rolls however causes an increase in the axial thrusts and therefore an increase in the forces of friction between the contact surfaces of the gripping means and those of the mating seatings of the chocks.

The forces of friction oppose the adjustment movement of the rolling rolls and cause considerable imprecisions in the system to control the thickness of the rolled product, and consequently an increase in the margins of tolerance of the thicknesses, which can exceed the limits of what is accepted by the market.

The forces of friction also cause a considerable wear of the contact surfaces where they are generated, further increasing the friction and reducing the efficiency of the gripping elements and therefore of the whole system by which the rolls are moved.

SUMMARY OF THE INVENTION

The present applicants have designed, tested and embodied this invention to overcome the shortcomings of the state of the art and to achieve further advantages.

The purpose of the invention is to provide a device to move the rolls in a four-high rolling stand for sheet and/or wide plate which eliminates the problem derived from the vertical shifting of the gripping means and the mating surfaces of the roll chock, providing a precise adjustment of the system to control the thickness of the rolled product and a reduction of the wear in the components of the system for moving the rolls themselves.

According to the invention the system to move the rolls has the gripping means cooperating with each of the seatings defined at the side of the chock and constrained to the end of a parallelogram.

The parallelogram system has its other ends connected to the axial drawing unit and is articulated on a plane parallel to the direction of movement of the rolls during the stage when the thickness is controlled, that is, on plane parallel to the movement at right angles with respect to the rolling plane.

According to the invention, the levers of the parallelogram are constrained to the drawing unit by means of a double rotation articulation.

The movements of the gripping means used in the chock therefore take place solidly with the movements of the relative roll, both when these movements are of the shifting type, and when they are of the sideways type, as for example in the case of crossing, and when they are at a right angle to the rolling plane.

This eliminates any slips between the contact surfaces of the components of the gripping system and consequently the forces of friction, which are the principle causes of wear on the components and also of the imperfect functioning of the system to control the thickness of the rolled product.

The solidity of the constraint between the gripping means and the chocks is further increased by pin or bracket elements or other functionally similar devices, appropriately applied to connect the two parts.

According to the invention, the system to activate/disactivate the gripping means is composed of a connecting arm pinned between the two gripping units acting on each roll which determines the simultaneous engagement/disengagementof the gripping means of the gripping units.

The movement of the connecting arm is determined by a jack screw acting on an articulation element of the arm itself.

According to a variant of the invention, the activation/disactivation of each of the gripping means is carried out by means of a jack screw attached to one end of the drawing unit and at the other end to the gripping means itself.

BRIEF DESCRIPTION OF THE DRAWINGS

The attached figures are given as a non-restrictive example and show some preferred embodiments of the invention as follows.

DETAILED DESCRIPTION OF THE PREFERRED EMBODIMENTS

Figure 1:
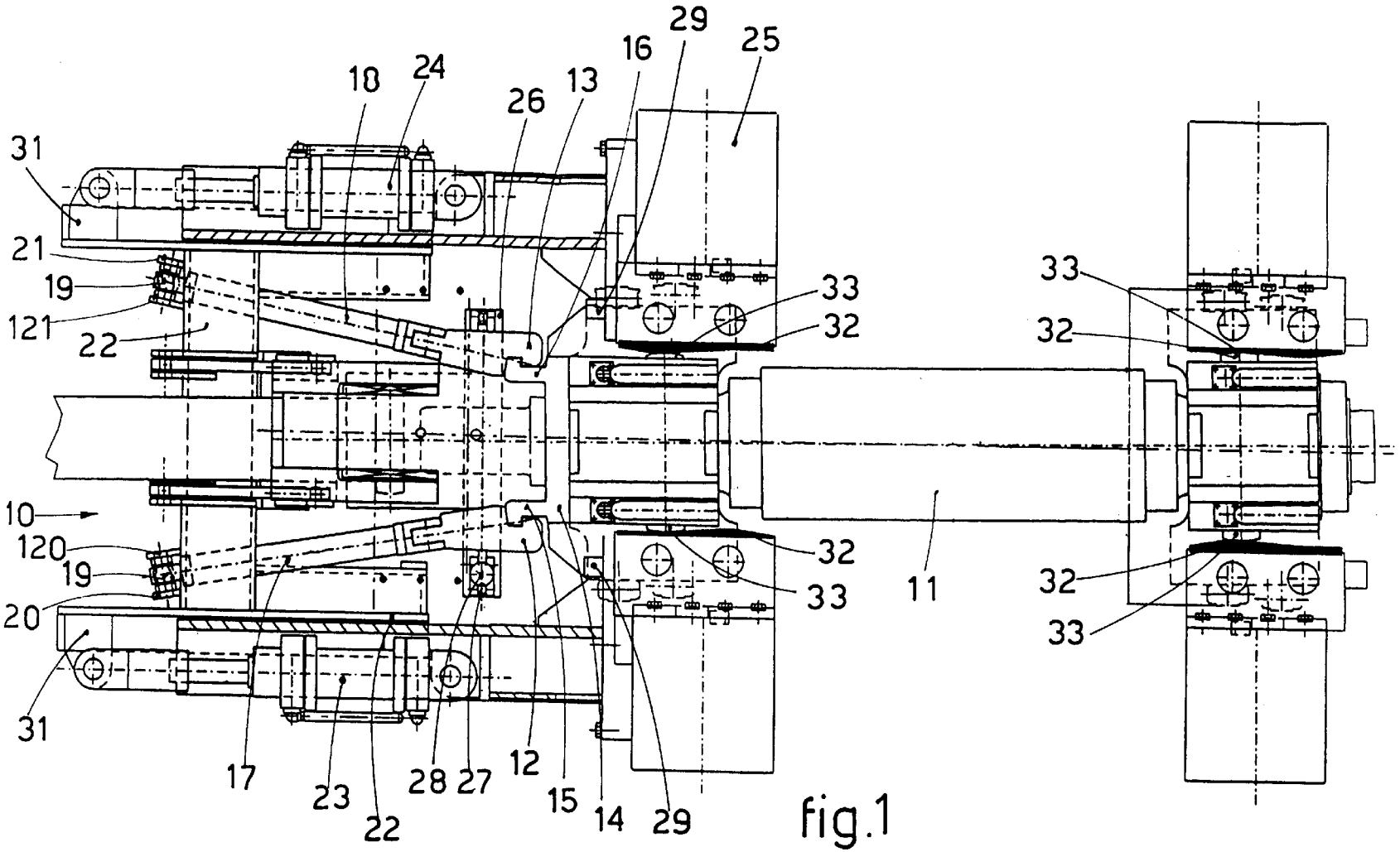
FIG. 1 shows the plan of a moving device according to the invention applied to the lower rolling roll of a horizontal four-high rolling stand.

With reference to the attached figures, the number 10 generally indicates the moving device for rolling rolls according to the invention, in this case applied to the lower roll 11 of a horizontal four-high rolling stand.

The moving device 10*a* of the upper roll 11*a* has the same structure and function as the device 10 of the lower roll 11 and is composed of the same elements as the latter.

The following description refers to the device 10 of the lower roll 11, but is in any case valid for the device 10*a* whose elements are marked, in the attached figures, with the same number as the corresponding element of the device 10 followed by the letter "a".

The moving device 10 comprises two units endowed with gripping means, in this case, composed of two jaws 12, 13.

The two jaws 12, 13 cooperate with flanges 15, 16, of mating shape to be found laterally on the chock 14 placed at one end of the rolling roll 11.

To be more exact, the jaws 12, 13 in the closed position, and therefore during rolling, close on the flanges respectively 15, 16 on the chock 14.

Each of the jaws 12, 13 is restrained to a pair of rods, respectively 17-117, 18-118, these being pinned at one end on the respective jaws 12, 13.

At the other end, the two pairs of rods 17-117 and 18-118 are restrained, by means of articulations 19 with two axes of rotation, to two plate elements respectively 20, 120 and 21, 121 disposed vertically.

According to a variant, the articulations 19 are spherical.

The paired rods 17-117, 18-118 are arranged slanting with respect to the rolling axis, so that their ideal extensions meet substantially in correspondence with the rolling axis and advantageously near the median point of the roll 11.

This allows a better transmission of the axial drawing force without causing imbalances and asymmetries in the movement.

This configuration therefore determines, in correspondence with each jaw 12, 13, a vertically articulated parallelogram system.

The plate elements 20, 120 and 21, 121 are attached to a sliding element 22 able to slide axially to the roll 11, and solidly connected, in correspondence with the anchoring point 31, to moving system comprising at least two jack screws 23, 24 which are in turn attached to the structure 25 of the rolling mill stand.

During the rolling process the crossing and/or shifting movement of the rolls is achieved by activating these jack screws 23, 24.

The movements of the jack screws 23, 24 cause the axial travel, in one direction or the other, of the sliding element 22, and this sliding element 22, by means of the rods 17-117 and 18-118 connected to the respective jaws 12, 13 solidly vised to the flanges 15, 16 of the chock 14, causes the relative roll 11 to be pulled or pushed.

The axial travel also causes, in this case, the crossed inclination of the rolls each with respect to the other.

This is achieved by means of the shaped conformation of the containing abutments 32 which cooperate with contact elements 33 on the lateral faces of the chock 14.

The crossing movement of the roll 11 is also allowed by the shaped conformation of the contact faces of the jaws 12, 13 and the flanges 15, 16 of the chock 14.

The vertical movement of the roll 11 with respect to the rolling plane during the stage when the thickness of the rolled product is checked is achieved by means of the appropriate means which cause the solid movement of the roll 11 between the jaws 12, 13 and the chock 14, and the oscillation on a vertical plane of the rods 17-117, 18-118 constrained to the relative articulations (19).

The movement of the rolling roll 11 occurs without any relative slipping between the contact faces and therefore without any harmful friction between the contact surfaces of the jaws 12, 13 and the respective flanges 15, 16 of the chock 14 on which the jaws 12, 13 act.

This is because of the strong vise constraint between the jaws 12, 13 and the relative flanges 15, 16 and the oscillatory movement of the articulated parallelogram system.

In this way the forces of friction which derive from the impact of the arriving product against the roll 11, or from surface defects of the roll 11 itself, are eliminated.

According to a variant of the invention the jaws 12, 13 have pin or bracket elements, not shown in the figures, which increase the solidity of the temporal union between the jaws 12, 13 and the respective flanges of the chock 14.

The activation/disactivation system of the jaws is composed, in this case, of a movable connecting arm 26 pinned to one end of a jaw 13 and at the other end to the top of a triangle element 27.

The triangle element 27 is in turn pinned to the other jaw 12 at one top and to a jack screw 28 at the remaining top.

The jack screw 28 is connected by means of a pin to the same jaw 12.

Figure 5:
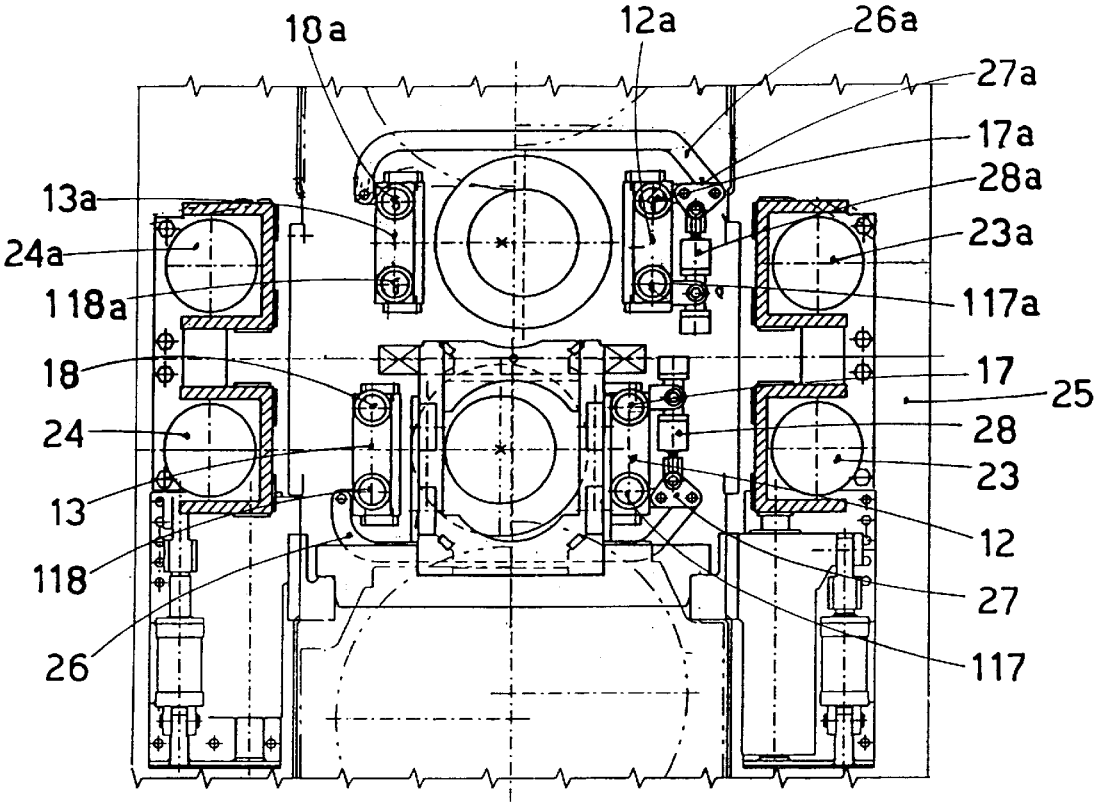
FIG. 5 shows a front section of the devices in FIG. 4 with gripping means activated.

During the rolling process, and therefore with the jaws 12, 13 closed on the flanges 15, 16 of the chock 14, the movable connecting arm 26 is in a substantially horizontal position (FIG. 5).

In order to replace the roll 11, the whole moving device 10 is made to move forward axially until the head of the jaws 12, 13 is substantially in line with the beating elements 29.

The jaws 12, 13 are disengaged from the chock 14 by acting on the jack screw 28 which pushes the movable connecting arm 26 into correspondence with the end which is constrained to the triangle element 27.

The movable connecting arm 26, in the movement caused by the jack screw 28, drags the jaw 13 to which it is pinned and brings it into contact with the relative beating element 29 and therefore releases it from the flange 16 on which it was closed.

Figure 2:
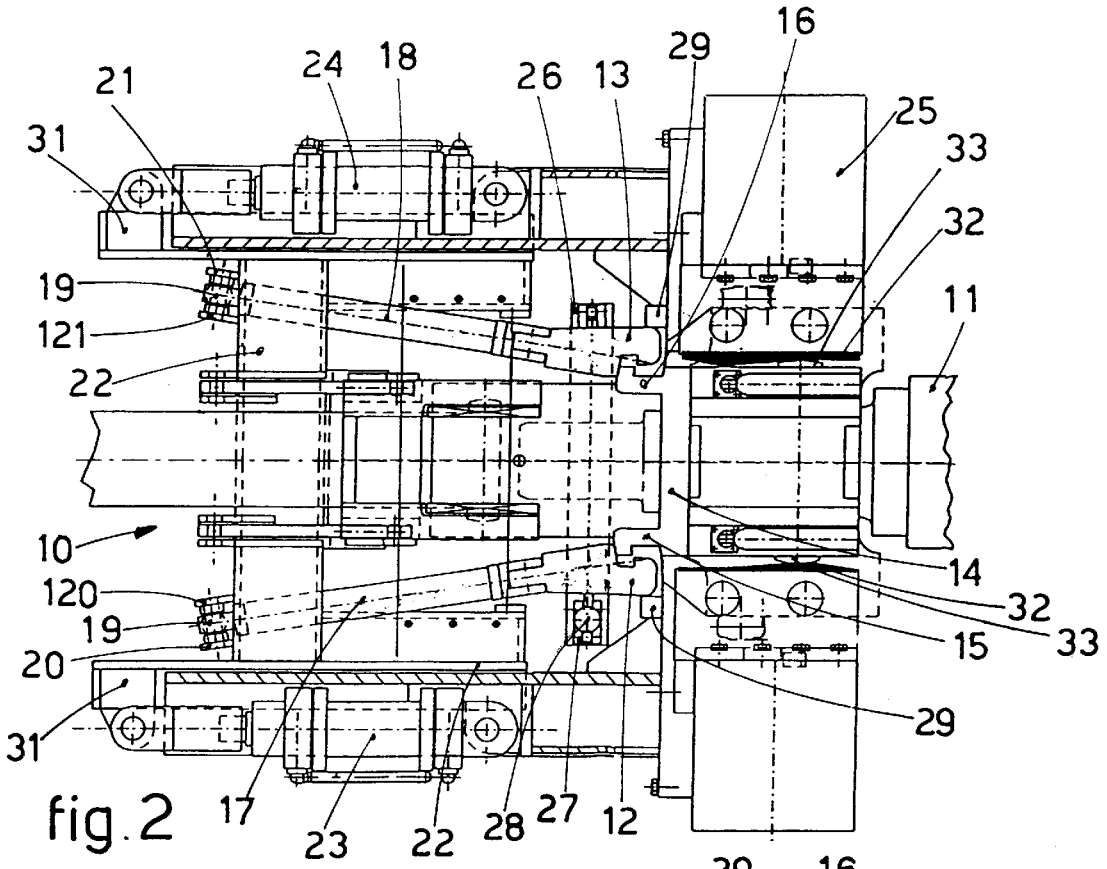
FIG. 2 shows the device in FIG. 1 with its gripping means disactivated.
Figure 6:
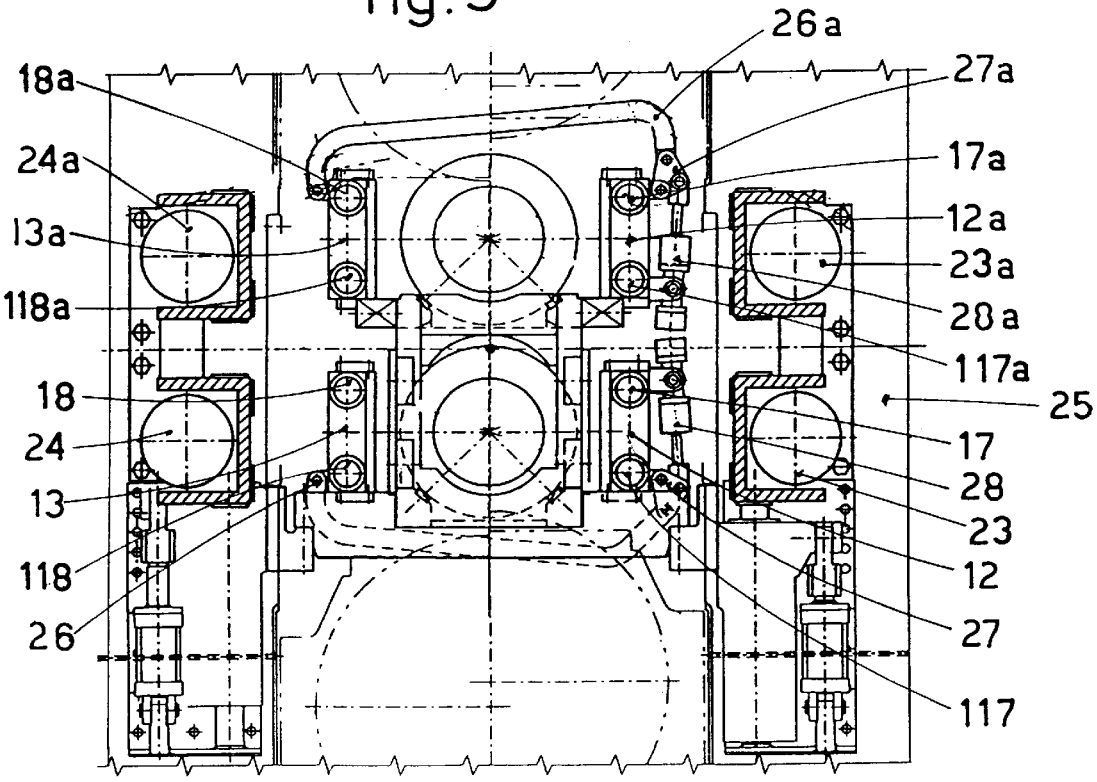
FIG. 6 shows a front section of the devices in FIG. 4 with gripping means disactivated.

Subsequently, while the jack screw 28 continues its thrusting action, the movable connecting arm 26 itself, acting as a lever on the jaw 13, pushes the jaw 12 into contact with its own beating element 29 and releases it from the mating flange 15 on which it was closed (FIGS. 2, 6).

The tightening of the jaws 12, 13 is achieved by taking the jack screw 28 back to its initial position, causing the movable connecting arm 26 to make the inverse movement.

The rotation of the jaws 12, 13 solidly to the respective rods 17-117, 18-118 is made possible by the articulations 19 to which the rods 17-117, 18-118 are constrained.

According to a variant of the invention the system to activate/disactivate the jaws 12, 13 is composed of paired actuating jack screws 30, constrained to the sliding element 22, each of which is connected to one of the jaws 12, 13 and acts directly on it.

Figure 3:
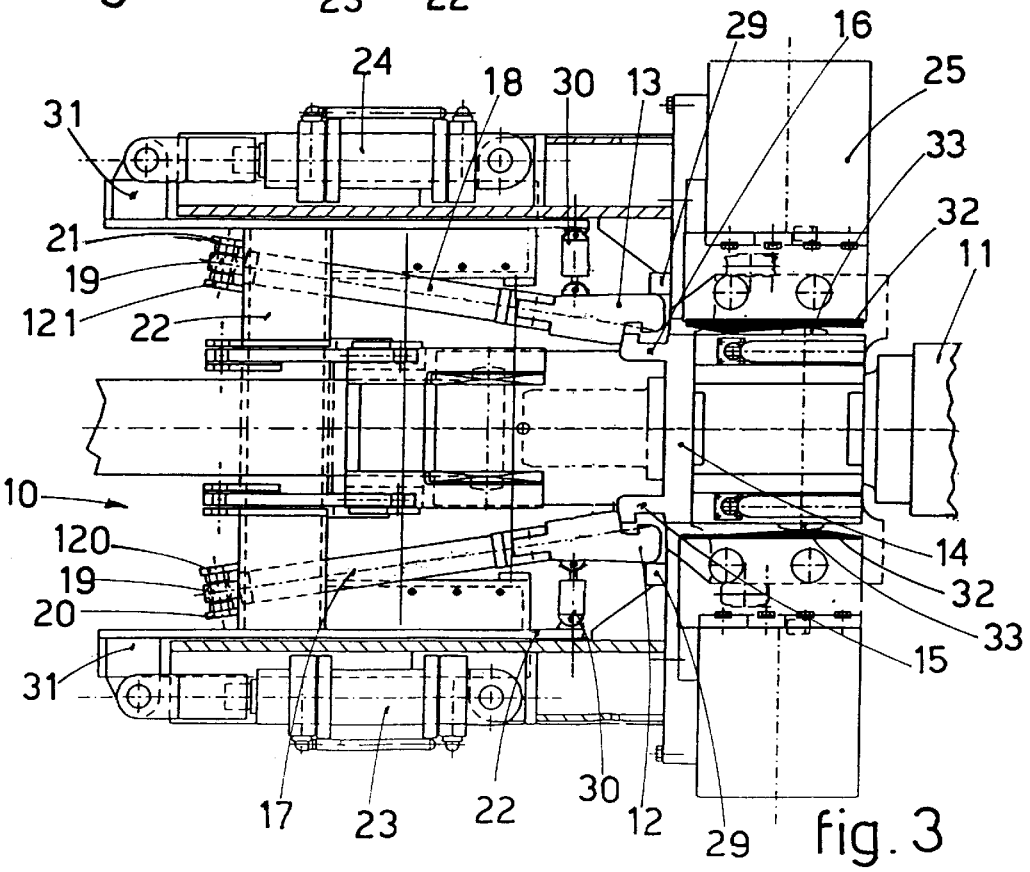
FIG. 3 shows the device in FIG. 2 adopting a variant of the system to activate/disactivate the gripping means
Figure 4:
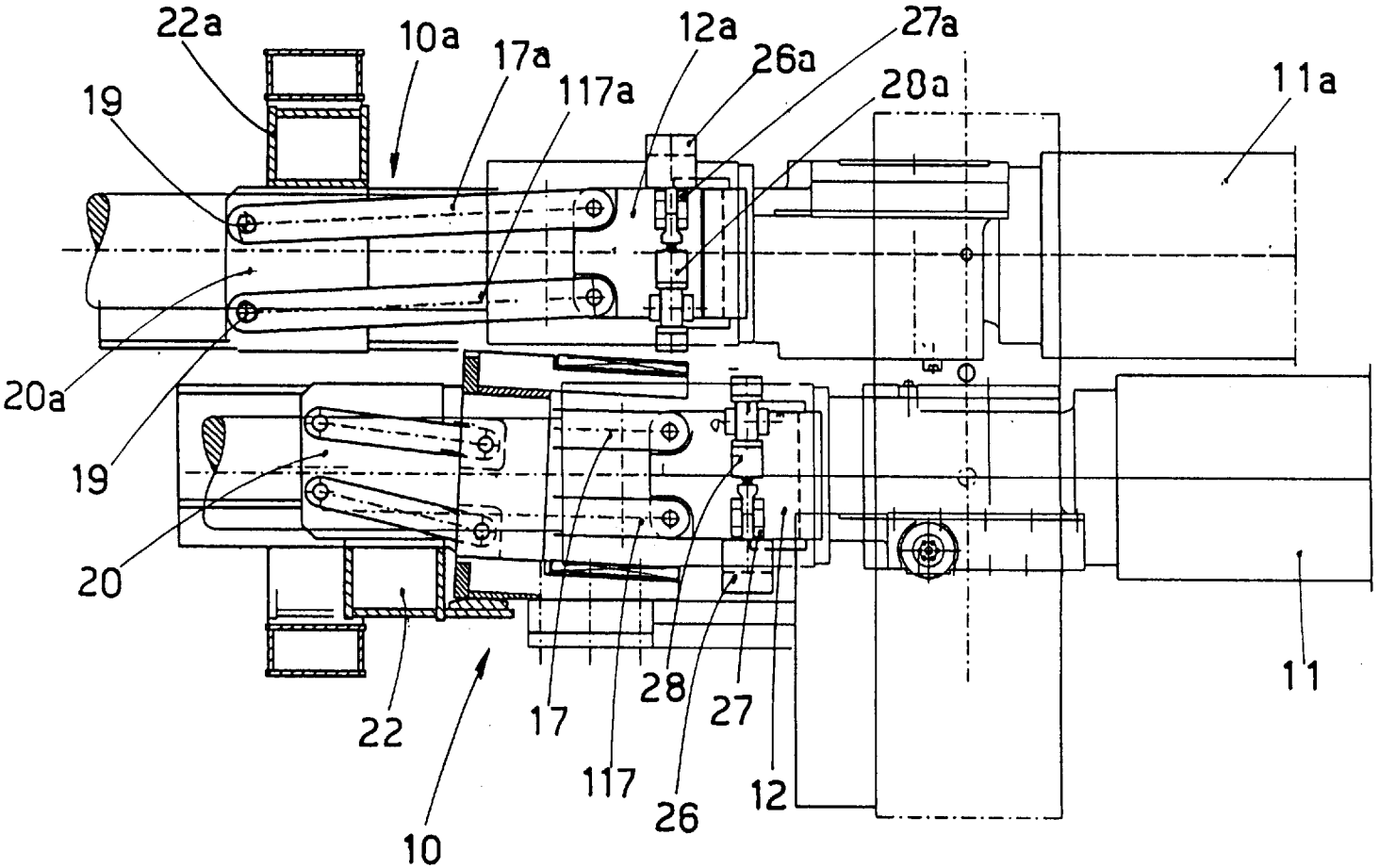
FIG. 4 shows a side view of the device in FIG. 1 and the corresponding device of the upper roll.

The coordinated action of the two jack screws 30 causes the dragging of the two jaws 12, 13 which are then brought into an active position and then vised to the mating flanges 15, 16 or into a rest position in contact with the beating elements 29 (FIG. 3).

We claim:

1. Device to move the rolls in a four-high rolling stand for sheets or wide plate, the device comprising gripping means cooperating with a chock of a respective lower roll or upper roll, the gripping means having at least a closed position in which the gripping means make the chock solid with an axial travelling system of the rolls and an open position in which the gripping means release the rolls, the gripping means cooperating with respective mating seatings defined laterally to the relative chock, characterised in that each of the gripping means is respectively connected to the axial travelling system by means of an articulated parallelogram unit movable on a plane which is substantially at a right angle to a rolling plane, the articulated parallelogram unit being composed of a pair of rods, respectively, pinned at the front to the respective gripping means and associated at the rear with the axial travelling system by means of an articulation with at least two axes of rotation, further comprising a system to open and close the gripping means which comprises a single control actuator acting on a movable connecting arm pinned at one end to one of the gripping means and at the other end to a triangle element pinned in its turn to another of the gripping means.

2. Device to move the rolls in a four-high rolling stand for sheets or wide plate, the device comprising gripping means cooperating with a chock of a respective lower roll or upper roll, the gripping means having at least a closed position in which the gripping means make the chock solid with an axial travelling system of the rolls and an open position in which the gripping means release the rolls, the gripping means cooperating with respective mating seatings defined laterally to the relative chock, characterised in that each of the gripping means is respectively connected to the axial travelling system by means of an articulated parallelogram unit movable on a plane which is substantially at a right angle to a rolling plane, the articulated parallelogram unit being composed of a pair of rods, respectively, pinned at the front to the respective gripping means and associated at the rear with the axial travelling system by means of an articulation with at least two axes of rotation.

3. Moving device as in claim 1, in which the paired rods are arranged on respective converging planes which cross substantially in correspondence with a rolling axis of the lower or upper roll with which the gripping means cooperates and near a median point of the the lower or upper roll with which the gripping means cooperates.

4. Moving device as in claim 1, in which the articulation connects the relative rods to a sliding element solidly connected to the axial travelling system.

5. Moving device as in claim 1, in which the articulations are spherical.

6. Moving device as in claim 4, further comprising a respective control actuator solidly connected to the sliding element for opening and closing the gripping means.

7. A four-high rolling stand for sheets or wide plate, comprising upper and lower rolls, each associated with chocks, gripping means cooperating with the chock of the respective lower or upper roll, the gripping means having at least a closed position in which the gripping means make the chock solid with an axial travelling system of the rolls and an open position in which the gripping means release the rolls, the gripping means cooperating with respective mating seatings defined laterally to the relative chock, characterised in that each of the gripping means is respectively connected to the axial travelling system by means of an articulated parallelogram unit movable on a plane which is substantially at a right angle to a rolling plane, the articulated parallelogram unit being composed of a pair of rods, respectively, pinned at the front to the respective gripping means and associated at the rear with the axial travelling system by means of an articulation with at least two axes of rotation.

* * * * *